United States Patent [19]

Panico

[11] 3,940,878

[45] Mar. 2, 1976

[54] WHIRLING TOY

[76] Inventor: Daniel Panico, 1953-C 19th St., Santa Monica, Calif. 90404

[22] Filed: Aug. 19, 1974

[21] Appl. No.: 498,385

[52] U.S. Cl. ..... 46/47; 46/51
[51] Int. Cl.[2] ..... A63H 1/32
[58] Field of Search ..... 46/47, 51, 52

[56] References Cited

UNITED STATES PATENTS

| | | | |
|---|---|---|---|
| 2,826,861 | 3/1958 | Hoffstadt | 46/47 |
| 3,550,312 | 12/1970 | East | 46/52 |

FOREIGN PATENTS OR APPLICATIONS

| | | | |
|---|---|---|---|
| 20,491 | 1889 | United Kingdom | 46/51 |
| 23,568 | 1912 | United Kingdom | 46/51 |
| 10,285 | 6/1908 | France | 46/51 |
| 592,723 | 2/1934 | Germany | 46/51 |
| 818,879 | 6/1937 | France | 46/47 |

*Primary Examiner*—Hugh R. Chamblee
*Assistant Examiner*—Robert F. Cutting
*Attorney, Agent, or Firm*—Fulwider, Patton, Rieber, Lee & Utecht

[57] ABSTRACT

A toy having an elongated handle connected by a flexible driving line to a whirling assembly comprising two flat rings joined together by a flexible connecting line. The driving line is connected to the whirling assembly by a double swivel connector, which is located beside one of the rings and permits rotation of both lines within the swivel. The rings rotate about an axis midway between them as the free end of the handle is rotated, and several different recreational exercises can be accomplished by different manipulations of the handle. In alternative embodiments, different swivel arrangements are provided to prevent twisting of the driving line and winding of the driving line around the connecting line.

9 Claims, 10 Drawing Figures

WHIRLING TOY

BACKGROUND OF THE INVENTION

This invention relates to toys, and has particular reference to a toy of the type in which an assembly of relatively heavy bodies is supported on an elongated line and adapted to be whirled, lasso-fashion, by manipulation of a handle to which the line is connected.

Numerous toys of this general type have been known in the past, one example being shown in U.S. Pat. No. 3,605,327 as having a string with a series of five balls threaded onto one end portion of the string and positioned in spaced apart relation, lengthwise of the string, to be whirled about the central ball of the series. Another interesting toy of this general type, shown in U.S. Pat. No. 2,826,861, comprises two spheres that are joined together by a stiff rod and are supported by a flexible line. Several other patents disclose toys in which a hoop or rope, similar to the loop of a lasso, is supported by a line.

The recreational value of such prior toys was to some extent limited, because of the limited variety of permissible activity, and in most cases because of the absence of any intrigue or mystery in the effects that could be achieved with the toys. The primary objective of the present invention is to provide a novel toy of the foregoing general character which is capable of use in a wider variety of ways, increasing as the level of skill of the user increases, so as to maintain interest and provide a progressively increasing challenge, and which, at the same time, involves a degree of intrigue or mystery in its operation.

SUMMARY OF THE INVENTION

The invention resides in a whirling toy which has a handle for manual manipulation, a driving line connected to the handle, and a whirling assembly on the driving line comprising two bodies, preferably substantially flat, planar bodies of about the same size and weight, that are joined together by a flexible connecting line. Means are provided for preventing twisting of the driving line and for preventing winding of the driving line around the connecting line during whirling of the two bodies and manipulation of the whirling bodies through different exercises. The connection of the driving line to the assembly is in an area spaced from the center of the connecting line, and preferably is closely adjacent one end of the connecting line.

In the preferred embodiment shown herein, the whirling bodies are rings of relatively dense plastic or similar material, and produce a particularly attractive and pleasing illusion or "figure" when whirling substantially in a plane perpendicular to the axis of rotation of the rings, this axis being midway between the rings along the connecting line. The "figure" appears to hang in mid-air, seemingly unconnected to the handle and detached from the control of the operator.

The preferred means for preventing twist and winding is a double-action swivel forming the connection between the driving line and the connecting line. This swivel is a bead which has two perpendicular through-passages, with the connecting line passing loosely through one through-passage and with the lower end portion of the driving line passing loosely through the other.

Alternatively, a conventional single-action swivel may be used to connect the driving line to the handle, and a one-way bead swivel can be used as the connector between the lines. Also, the connecting line can be rotatably mounted on each of the rings, and the driving line can be tied directly to the connecting line.

Other aspects and advantages of the invention will become apparent from the following detailed description, taken in conjunction with the accompanying drawings.

DETAILED DESCRIPTION OF THE FIRST EMBODIMENT

Figure 3:
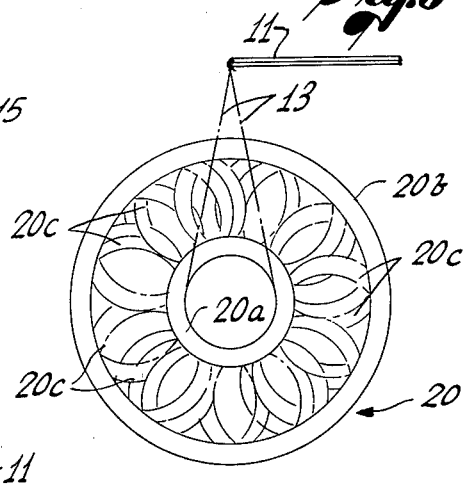
FIG. 3 is a side view showing the appearance of the whirling "figure" during operation, with the whirling assembly disposed in a vertical plane.

As shown in the drawings for purposes of illustration, the invention is embodied in a whirling toy, indicated generally by the reference number 10, and comprising a lever-like handle 11 in the form of an elongated, relatively stiff rod that is held in the hand 12 of a user, a driving line 13 attached to one end of the handle, the left end in the drawings, and a whirling assembly 14 that is attached to the driving line in spaced relation with the handle, and includes two bodies 15 and 17 that are connected together by a line 18. When the handle is properly manipulated, the two bodies are spread apart by centrigual force, and are caused to rotate generally in a common plane about an axis 19 disposed between the bodies and perpendicular to the connecting line 18. When so rotating, the whirling assembly produces an illusion or "figure", generally as illustrated in FIG. 3.

Figure 7:
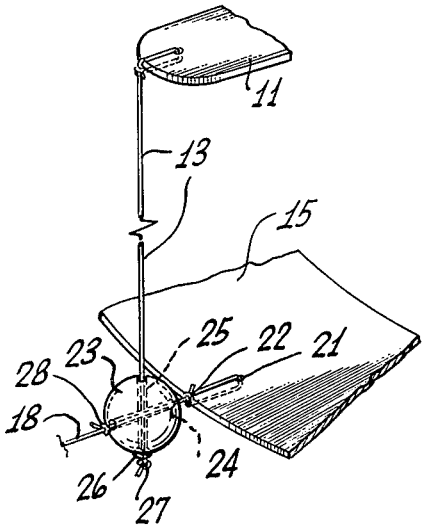
FIG. 7 is an enlarged fragmentary perspective view showing the end of the handle, parts of the driving line, the double-action swivel connector, and parts of the connecting line and one whirling body.

The driving line 13 is composed of any suitable material, one being nylon monofilament, and is attached by its upper end to the free end of the handle 11, herein by a simple tie through a hole in the end of the handle. The bodies 15 and 17 may take various forms, the preferred form being two rings of relatively stiff plastic, which may be brightly colored for an attractive appearance. The connecting line 18 also may be nylon monofilament, and is attached at its ends to the peripheral portions of the two rings, this being accomplished in the illustrative embodiment simply by passing the connecting line through holes 21 in the rings (see FIG. 7) and securing it to the rings with knots 22. An advantage of monofilament is the virtual invisibility of the lines, when the assembly is whirling.

An important aspect of the invention is the manner of connection of the driving line 13 to the whirling assembly 14 formed by the two rings 15 and 17 and the connecting line 18. As shown most clearly in FIGS. 2 and 7, this preferably is accomplished by means of a double-action swivel connector 23 that allows each line 13, 18 to rotate about its longitudinal axis relative to the other line. This permits the assembly to rotate without twisting of the driving line 13, and prevents winding of the driving line around the connecting line as certain movements of the whirling assembly are performed.

Herein, the swivel-connector 23 is a spherical bead having two intersecting, diametrical throughpassages 24 and 25 that preferably are perpendicular to each other, and are offset slightly from each other to prevent rubbing of the two lines where they cross inside the swivel. The driving line 13 passes loosely through the passage 25 and is held in place by a washer 26 and knot 27 in the end of the line 13. The connecting line 18 is threaded through the passage 24. Each line turns freely within the swivel 23.

It will be apparent that, for the development of rotational motion in the whirling assembly 14, the connector 23 should be spaced from the center of the assembly. In addition, rotational stability of the whirling assembly is enhanced as this spacing is increased. Therefore, the optimum position for the swivel connector 23 is adjacent one of the rings 15, 17.

In the illustrative embodiment, the swivel connector 23 is positioned beside the ring 15, and its movement along the connecting line 18 away from this ring is blocked by an abutment 28, which can be an enlargement in the connecting line, larger than the passage 24, herein formed by a simple overhand knot. The knot 28 is spaced from the knot 22 (see FIG. 7) a distance slightly larger than the diameter of the swivel connector 23, to insure that the line turns freely in the connector.

Although dimensions of the various parts are not critical, a few points should be observed for optimum design. First, the handle 11 should be long enough to allow a small movement of the hand of the user to create a relatively large amount of movement in the whirling assembly 14. This serves as a part of the mystery as to the source and magnitude of movement in the whirling assembly. In addition, the driving line 13 should be long enough to permit the rings 15 and 17 to rotate when the axis of rotation is parallel to the handle 11, with clearance between the adjacent portions of the "figure" 20 and the handle. The rings should be sufficiently heavy, in relation to their surface areas, to overcome the tendency to deflect as a result of wind resistance, and in this respect, it has been found that lightweight cardboard rings are not as good as plastic, or heavier cardboard. Whatever the material, it should be relatively rigid, to eliminate bending.

As a specific example of the specifications for one suitable whirling toy, the handle 11 may be on the order of 27 inches long, the driving line 13 about 20 inches, the rings 15 and 17 8 to 9 inches in outside diameter and 5 to 6 inches in inside diameter, and the connecting line 18 5 to 6 inches in length. These dimensions are to be taken as merely illustrative, however, and not as limitations of the present invention.

In using the toy 10, the typical starting position is that shown in FIG. 1, with the handle 11 extending outwardly, perhaps inclined downwardly to some extent, and with the driving line 13 and the whirling assembly 14 hanging below the free end of the handle. The handle is manipulated to rotate the free end (as indicated at 29 in FIG. 2) and to begin swinging the whirling assembly, which initially is basically formless and disorganized. The initial movement of the free end is in a relatively large circle, perhaps on the order of ten to twelve inches in diameter.

In response to the centrifugal force developed, the lower ring 17 will begin to swing out, away from the upper ring 15, and to rise toward the level of the upper ring. At the same time, the upper ring begins to swing out on the opposite side, away from the lower ring, toward a position in a horizontal plane extending through the swivel connector 23.

The rate of rotation of the handle 11 initially is relatively slow, to begin swinging the assembly 14, and then is progressively increased, to accelerate the swinging. This, of course, increases the centrifugal force tending to separate the rings, until they are whirling in the manner illustrated in FIGS. 2 and 4. The free end of the handle is rotated in a smaller and smaller circle as the rate increases, and when the condition illustrated in FIGS. 2 and 4 is attained, the circle 29 of rotation of the free end is relatively small.

Figure 2:
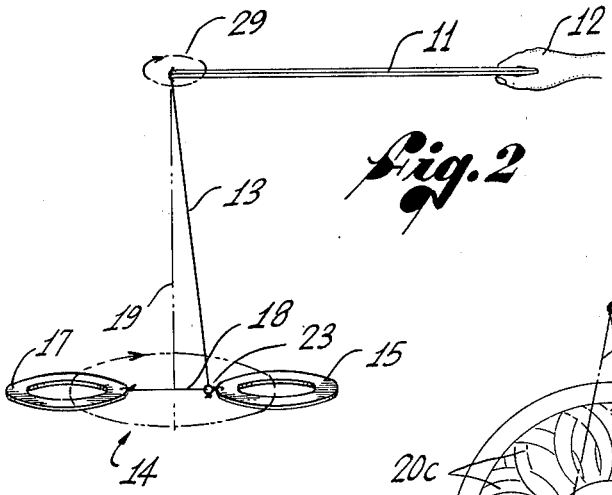
FIG. 2 is a perspective view similar to FIG. 1 but showing one condition of the parts of the toy after motion has been imparted to the bodies to cause them to whirl in a generally horizontal plane.
Figure 4:
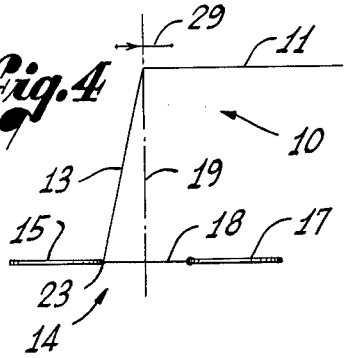
FIG. 4 is a diagrammatic side elevational view of the toy, with the bodies in a horizontal plane and rotated 180° from the condition shown in FIG. 2.
Figure 5:
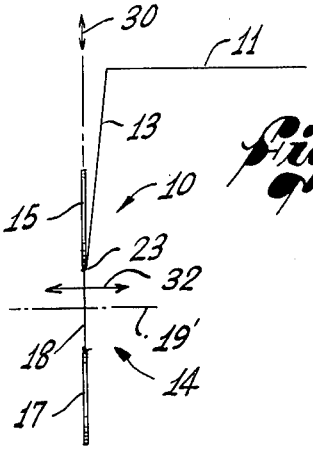
FIG. 5 is a view similar to FIG. 4 showing a condition of the parts of the toy after the rotation has been changed to the substantially vertical plane, as in FIG. 3, with an arrow indicating a back and forth swinging motion that can be imparted to the whirling bodies.

Illustrated in FIG. 5 is a first variation that is possible with the toy 10, after the initial condition in FIGS. 2 and 4 has been achieved. It can be seen that the rings 15 and 17 are disposed in a vertical plane, and are rotating about a horizontal axis 19', still midway between the rings but now generally parallel to the handle 11. This is accomplished by changing the motion of the free end from rotational to translatory, that is, up and down, as indicated by the arrow 30 in FIG. 5.

Figure 6:
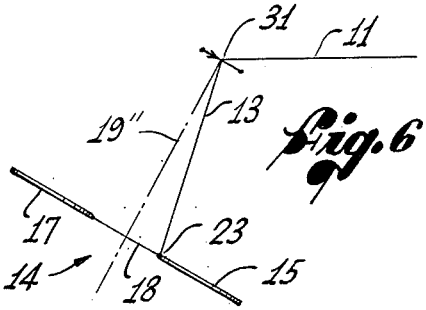
FIG. 6 is a view similar to FIG. 4 showing rotation in an inclined plane.

As another alternative, the free end of the handle 11 can be rotated in an inclined plane, as indicated by the arrow 31 in FIG. 6. This will cause the plane of rotation of the rings 15 and 17 to shift from the horizontal plane, of FIGS. 2 and 4, to an inclined plane, as shown in FIG. 6, generally parallel to the plane of rotation of the free end of the handle. The axis 19'' of rotation of the rings now will be inclined, as shown in FIG. 6.

A representation of the "figure" 20 is shown in FIG. 3, generally as it appears in all of the various attitudes of the whirling bodies. Basically, the inner and outer peripheries of the "figure" appear as solid bands **20*a* and 20*b*, and the space between them appears as moving, petal-like arcuate sections 20*c***.

The "figure" 20 formed by the rotating assembly 14 thus can be moved from plane to plane, and it also can be moved about in a variety of secondary ways. For example, the "figure" can be maintained behind one's back; it can be thrown upward in the air and "caught," whirling, on its way down; and it can be towed like a kite, rising in the air as it rotates in an inclined plane. Also, the entire whirling figure can be swung back and forth in its different attitudes.

The swivel connector 23 permits the driving line 13 to be disposed at any angle relative to the connecting line 18, and the centrifugal force maintains the integrity of the "figure" in the different attitudes and motions. This swinging motion is illustrated by the arrow 32 in FIG. 5, indicating lateral swinging during rotation in a vertical plane. Although it might logically be assumed that the whirling "figure" would foul with the driving line 13 during such swinging, it has been found that, instead, the line passes through the "figure" as the latter passes back and forth.

Figure 1:
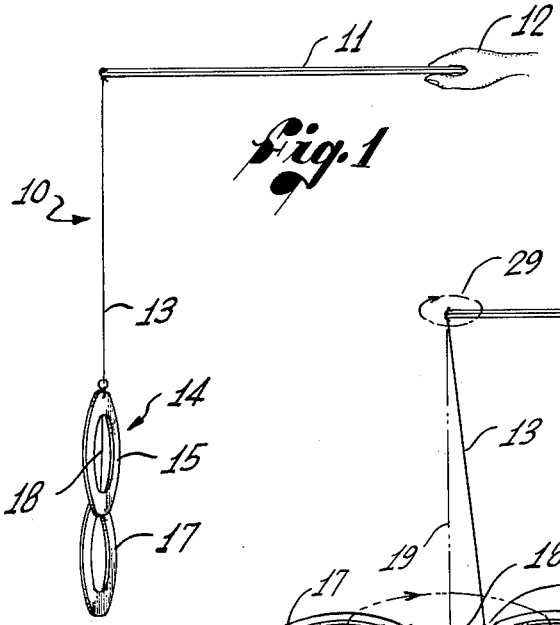
FIG. 1 is a side view showing a whirling toy embodying the novel features of the present invention, held in the hand of a user and shown in an inactive, starting position.

This is but one of the intriguing aspects of the toy 10 of the present invention, which also is intriguing in its transition from the formless, disordered state of FIG. 1 to the orderly state produced by centrifugal force, and in the seeming detachment of the whirling figure from the operator. These aspects, and the variety of recreational exercises that can be performed as skill and dexterity increase, distinguish the toy from prior toys of this general type.

DETAILED DESCRIPTION OF THE ALTERNATIVE EMBODIMENTS

Figure 8:
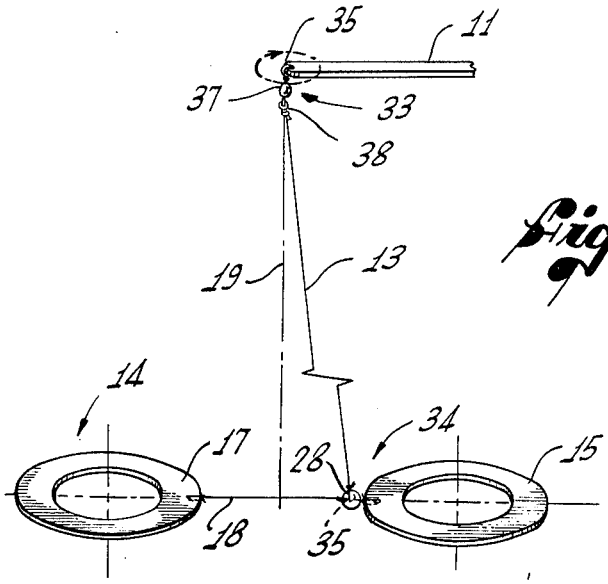
FIGS. 8, 9 and 10 are somewhat enlarged fragmentary views, generally similar to parts of FIG. 2, illustrating alternative embodiments of the invention.
Figure 9:
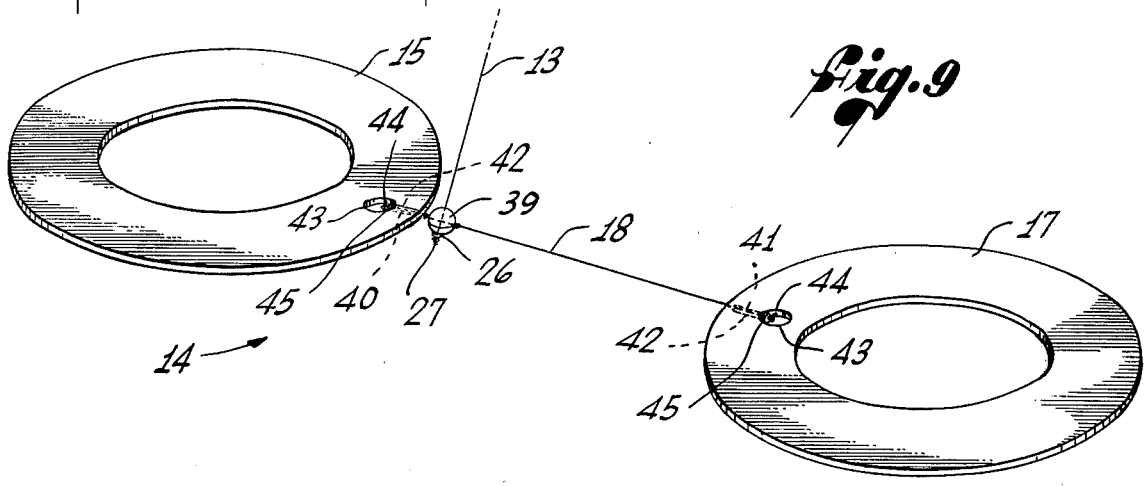
Figure 10:
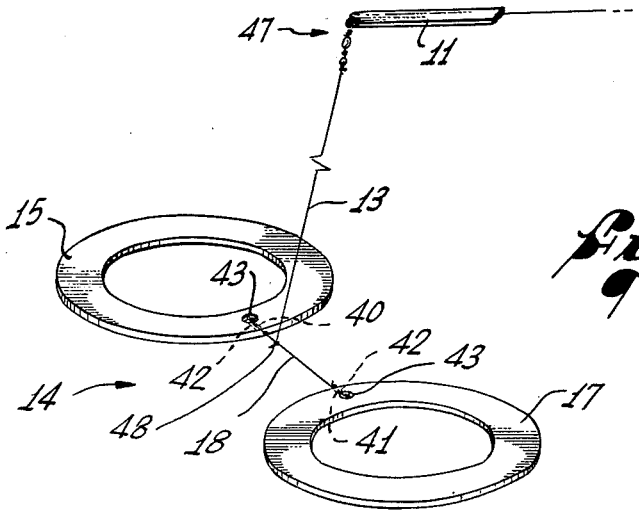

Shown in FIGS. 8, 9 and 10 are three variations in the whirling toy with alternative arrangements of the means for preventing twisting and winding of the lines. Parts of these embodiments that correspond to parts shown in FIGS. 1 through 7 are indicated by the same reference numbers that are used in FIGS. 1 through 7.

First, in FIG. 8, a standard swivel 33 is interposed between the handle 11 and the driving line 13, to prevent twisting of the latter by the whirling assembly 14. A single-action bead swivel 34 is tied to the other end of the driving line and formed with a through-passage 35 through which the connecting line 18 loosely extends.

The swivel 33 has an upper eye 35 clipped to the handle, a central swivel bead 37, and a lower eye 38 to which the driving line 13 is tied. In other respects, this embodiment may be the same as the first.

Shown in FIG. 9 is another alternative in which a bead swivel 39 at the lower end of the driving line 13 provides a single swiveling action, but this time for the driving line 13. The latter is rotatable in the bead as in the first embodiment, but is non-rotatably fastened to the connecting line 18.

The connecting line 18, however, has ends 40 and 41 which are rotatably secured to the rings 15 and 17, so that the connecting line can rotate about its longitudinal axis relative to the rings. For this purpose, each end of the connecting line extends loosely through a passage 42 in the ring, and into an aperture 43 in the body of the ring, where the line is knotted, as shown at 44, to form an abutment preventing withdrawal of the line from the passage 42. A small antifriction washer 45 between each knot 44 and the wall of the aperture lessens resistance to turning.

A third alternative, shown in FIG. 10, combines the swivel mounting of the ends 40, 41 of the connecting line 18 in passages 42 and apertures 43 in the rings 15 and 17, with a standard swivel 47 between the driving line 13 and the handle 11, as described in connection with the first alternative embodiment (FIG. 8). This arrangement similarly prevents twisting and winding of the lines 13 and 18 even though the driving line 13 is tied directly to the connecting line 18, as indicated at 48.

Each of the foregoing embodiments provides a whirling toy that can be manipulated in the manner described in connection with the first embodiment. All are relatively simple and inexpensive in construction, yet provide interesting and pleasant entertainment, and a continuous and growing challenge.

While different specific embodiments of the invention have been illustrated and described, it will be apparent that various other modifications, additions, and changes may be made without departing from the spirit and scope of the present invention.

I claim:

1. A whirling toy, comprising:
an elongated handle having one end portion adapted to be gripped in the hand, and an opposite, free end portion adapted to be moved through rotational and translatory motions;
an elongated flexible driving line of preselected length connected at one end to said free end portion of said handle;
two flat bodies of substantially the same size, shape and weight;
a flexible connecting line substantially shorter than said driving line, said connecting line extending between said bodies and having opposite end portions joined to corresponding peripheral portions of said bodies, thereby joining said bodies together in a whirling assembly;
and a double-action swivel means connecting said driving line to said connecting line adjacent one of said bodies, and permitting each of said lines to rotate about its longitudinal axis relative to said swivel means, whereby said whirling assembly may be put into rotation about an axis between said bodies, and generally in a selected plane, by rotation of said free end of said handle, and while rotating, may be variably manipulated with said handle.

2. A whirling toy as defined in claim 1 in which each of said bodies is a ring composed of relatively dense and stiff material and having inner and outer circular edges, and said connecting line is joined to each ring adjacent the outer edge thereof.

3. A whirling toy as defined in claim 1 in which said double-action swivel means is a connector having two through-passages, said connecting line passing loosely through one of said through-passages, said driving line passing loosely through the other, and said driving line having means thereon holding said connector rotatably on the driving line.

4. A whirling toy as defined in claim 3 further including means for maintaining said connector in a preselected position longitudinally of said connecting line.

5. A whirling toy as defined in claim 1 in which said handle is an elongated, relatively stiff rod.

6. A whirling toy, comprising:
a handle adapted to be gripped in the hand;
an elongated driving line;
means connecting one end of said driving line to said handle;
two bodies of substantially the same size and weight;
a flexible connecting line extending between said bodies;
means joining the opposite ends of said connecting line to said bodies to connect them together in a whirling assembly of fixed length;
and means connecting said driving line to said connecting line in an area spaced a preselected and substantially fixed distance from the center of said connecting line thereby to support said assembly in an apparently formless manner when at rest, and to put the assembly into rotation in a selected plane through manipulation of said handle, said connecting line having nothing of any substantial mass on it between said two bodies, to avoid interference with the rotation of said assembly;

said joining means and said connecting means including means permitting said assembly to rotate about an axis between said bodies without twisting said driving line and preventing winding of said driving line about said connecting line during movement of the plane of rotation of said bodies.

7. A whirling toy as defined in claim 6 in which said bodies are flat and substantially planar in shape.

8. A whirling toy as defined in claim 6 in which said bodies are rings.

9. A whirling toy as defined in claim 6 in which said means connecting said driving line to said connecting line includes a swivel connector having a passage through which said connecting line loosely extends, means locating said connector along said connecting line adjacent one of said bodies, a second passage in said connector through which said driving line loosely extends, and means holding said connector rotatably on the driving line.

* * * * *